US009556589B2

(12) United States Patent
Brooks et al.

(10) Patent No.: US 9,556,589 B2
(45) Date of Patent: Jan. 31, 2017

(54) WORKING MACHINE AND CONTROL SYSTEM

(71) Applicant: JC Bamford Excavators Ltd, Uttoxeter (GB)

(72) Inventors: Graham Mark Brooks, Stoke-on-Trent (GB); Richard Brooks, Rocester (GB); Samuel Josef Bell, Rocester (GB)

(73) Assignee: J. C. Bamford Excavators Limited, Uttoxeter, Staffordshire (GB)

( * ) Notice: Subject to any disclaimer, the term of this patent is extended or adjusted under 35 U.S.C. 154(b) by 94 days.

(21) Appl. No.: 14/279,103

(22) Filed: May 15, 2014

(65) Prior Publication Data

US 2014/0343804 A1 Nov. 20, 2014

(30) Foreign Application Priority Data

May 20, 2013 (GB) ..... 1309023.8

(51) Int. Cl.

| | |
|---|---|
| ***E02F 9/20*** | (2006.01) |
| ***E02F 3/34*** | (2006.01) |
| ***E02F 3/40*** | (2006.01) |
| ***E02F 9/22*** | (2006.01) |

(52) U.S. Cl.

CPC ..... *E02F 9/2012* (2013.01); *E02F 3/3402* (2013.01); *E02F 3/405* (2013.01); *E02F 9/221* (2013.01); *F15B 2211/327* (2013.01); *F15B 2211/6346* (2013.01); *F15B 2211/6658* (2013.01); *F15B 2211/85* (2013.01)

(58) Field of Classification Search

CPC ..... F15B 2211/6343; F15B 2211/6658; F15B 2211/85; E02F 9/2004; E02F 9/2012; E02F 9/221; E02F 3/405

USPC ..... 701/50

See application file for complete search history.

(56) References Cited

U.S. PATENT DOCUMENTS

| | | | | |
|---|---|---|---|---|
| 5,235,809 | A | 8/1993 | Farrell | |
| 5,287,699 | A | 2/1994 | Takamura et al. | |
| 5,860,231 | A * | 1/1999 | Lee | E02F 9/2025 172/2 |
| 6,757,992 | B1 | 7/2004 | Berger et al. | |
| 6,763,661 | B2 * | 7/2004 | Tabor | E02F 3/405 60/327 |
| 7,117,952 | B2 | 10/2006 | Bares et al. | |
| 7,269,943 | B2 | 9/2007 | Buckmier et al. | |
| 7,270,046 | B2 | 9/2007 | Stephenson et al. | |

(Continued)

FOREIGN PATENT DOCUMENTS

| | | |
|---|---|---|
| GB | 1 187 527 A | 4/1970 |
| JP | H08 165678 A | 6/1996 |

OTHER PUBLICATIONS

Search Report for EP 14 16 8908, dated Sep. 29, 2014.
Search Report for GB 1309023.8, dated Nov. 8, 2013.

*Primary Examiner* — John Q Nguyen
*Assistant Examiner* — Anshul Sood
(74) *Attorney, Agent, or Firm* — Marshall, Gerstein & Borun LLP

(57) ABSTRACT

A working machine comprising a ground engaging structure and a propulsion system for moving the working machine via the ground engaging structure. A body is supported on the ground engaging structure, and a working arm is connected to the body and has a carriage at one end for receiving an attachment. A control system is provided for selectively and variably oscillating the carriage.

5 Claims, 6 Drawing Sheets

(56) References Cited

U.S. PATENT DOCUMENTS

| | | | |
|---|---|---|---|
| 7,726,125 | B2 | 6/2010 | Brinkman et al. |
| 2006/0248885 | A1 | 11/2006 | Buckmier et al. |

* cited by examiner

WORKING MACHINE AND CONTROL SYSTEM

FIELD OF THE INVENTION

The present invention relates to a working machine, a control system for a working machine, and/or a method of operation of a working machine.

BACKGROUND OF THE INVENTION

When operating a working machine of the type having a working arm and an attachment connected thereto (e.g. a materials handling vehicle such as a telescopic handler, an excavator, a backhoe loader, etc, with a shovel, bucket or forks, etc connected thereto) it is sometimes desirable to shake the attachment. The attachment may be shaken to dislodge stuck material, level material in an attachment, evenly distribute material from the attachment, or to break bales, feed cake, bundles or the like.

In hydraulically operated and manually controlled systems with a mechanical or pilot hydraulic connection between the input (e.g. joystick) and a control valve, the attachment is shaken using back and forth movement of the joystick to selectively supply fluid to a hydraulic actuator(s) that controls the movement of the attachment.

However, in electro-hydraulic systems it is not possible to use this method, because there is no direct linkage to the hydraulic control valve, which means there is a degree of latency in the system. The latency means that an operator cannot easily find a desired frequency and/or amplitude of oscillation to achieve a required shake.

SUMMARY OF THE INVENTION

The present invention seeks to provide a control system for a working machine that permits an operator to shake an attachment at variable frequency and/or amplitude.

A first aspect of the invention provides a working machine comprising: a ground engaging structure; a propulsion system for moving the working machine via the ground engaging structure; a body supported on the ground engaging structure; a working arm connected to the body and having a carriage at one end for receiving an attachment; and a control system for selectively oscillating the carriage, wherein the control system comprises: an actuator configured and arranged to selectively oscillate the carriage; an electronic controller configured to control the actuator; and a user input device in communication with the controller; wherein the user input device comprises an oscillation input configured to selectively transmit an oscillation signal to the electronic controller to indicate a desired amplitude and/or frequency of oscillation of the carriage, wherein the oscillation input is variable to alter the oscillation signal transmitted to the electronic controller; and wherein the electronic controller is configured to upon receipt of the oscillation signal selectively activate the actuator to oscillate the carriage at the desired frequency and/or amplitude indicated by the oscillation signal.

Advantageously, the control system permits an attachment connected to the working machine to be oscillated with a variable amplitude and/or frequency without particular operator skill. Further, the use of the electronic controller to control the actuator means that the oscillations are repeatable, i.e. have consistent amplitude and/or frequency.

The actuator may be configured to directly oscillate the carriage. For example, the carriage may be oscillated via a pivoting oscillation of the carriage with respect to the working arm.

The actuator may be configured to indirectly oscillate the carriage. For example, the carriage may be oscillated via oscillation of the working arm. The working arm may be a telescopic working arm, and the carriage may be oscillated via extension and retraction of the working arm.

The oscillation signal may include an intensity indicator. The controller may be configured to use an algorithm and/or lookup table for transforming the intensity indicator to a desired frequency and/or amplitude of oscillation. Use of an intensity indicator to specify the frequency and the amplitude of the oscillations eases usability for a user.

The input device may comprise a position input configured to transmit a position signal to the electronic controller to indicate a desired change of position of the carriage. The electronic controller may be configured to upon receipt of the position signal activate the actuator to move the carriage as desired.

The change of position may be a change of angular position and/or a change in spatial position with respect to the body.

The controller may be configured to signal actuation of the actuator to move the carriage from a first position to a second position simultaneously whilst oscillating the carriage at the desired amplitude and/or frequency. Simultaneous movement and oscillation of the carriage may be selectively applied dependent upon a signal received from an indicator of the control system.

The indicator may be a button or switch provided on a user interface of the working machine.

The controller may be configured to move the carriage in a desired direction at a slower rate when simultaneously moving and oscillating the carriage than when only moving the carriage.

The oscillation input and the position input may be positioned so as to be accessible by a user at the same time using a single hand.

The position input may comprise a control device that a user can move to indicate the desired change of position of the carriage.

The desired change of position indicated by the position signal may be proportional to the position of the control device with respect to a neutral position of the control device.

The control device may be configured such that the oscillation signal transmitted to the controller is dependent upon the position of the control device.

The desired frequency and/or amplitude of the oscillations indicated by the oscillation signal may be proportional to the position of the control device with respect to a neutral position of the control device.

Preferably, the control device is a joystick.

The joystick may be an analogue joystick. Alternatively, the joystick may be a digital joystick.

The controller may be configured to detect when the joystick is in a neutral position and only send a signal to actuate oscillations of the carriage when the joystick is out of the neutral position. This feature provides an additional safety feature.

Use of a joystick to indicate the desired position and/or oscillation intensity provides an ergonomic control system and can reduce operator fatigue. Alternatively, one or more dials or scroll buttons may be used to indicate the oscillation signal to be transmitted.

The actuator may comprise a hydraulic actuator.

The actuator may be operably connected between the working arm and the carriage, between the body and the working arm, or between components of the working arm.

The working machine may comprise a valve configured and arranged for controlling fluid flow to the hydraulic actuator. The valve may be a spool valve.

The working machine may comprise a solenoid for controlling the valve.

The working machine may comprise a control system activation operator that is operable to enable or disable the control system. The control system activation operator provides an additional safety feature.

The communication between the user input device and the controller may use CAN bus messages.

The working machine may comprise a first actuator between the body and the working arm or between components of the working arm and a second actuator between the carriage and the working arm. The input device and control system may be configured to actuate both the first and second actuators.

The working machine may comprise a joystick, and the position of the joystick may indicate whether to move or oscillate the working arm and/or the carriage via the first and/or second actuators.

The working arm may be a telescopic working arm. The working machine may comprise a third actuator to extend and retract the working arm. The input device and control system may be configured to control the position and oscillations of the extension and retraction of the working arm.

The working machine may be a telescopic handler, a backhoe loader, an excavator, or any other type of materials handling vehicle.

An alternative aspect of the invention may provide a control system according to the first aspect of the invention.

In a second aspect the invention provides a control system for a working machine of the type having a working arm connected to a body and a carriage at one end of the working arm for mounting an attachment thereto; the working machine having two modes of operation, a first mode where the position of the attachment is adjustable relative to the body, and a second mode where the attachment is oscillated relative to the body, movement of the attachment being achieved using an actuator; the control system comprising: an input device having a position input configured to receive a desired change of position of a carriage of a working machine relative to a body of a working machine, and an oscillation input configured to receive an indication from a user that a carriage of a working machine should be oscillated and configured to receive an input from a user indicating the frequency and/or amplitude of the oscillations; and a controller; wherein the position input is configured to send a signal to the controller indicating the desired rate of change of position of the carriage, and the oscillation input is configured to send a signal to the controller indicating when the carriage should be oscillated and the frequency and/or amplitude of said oscillation; and wherein the controller is configured to, upon receipt of the position signal and/or oscillation signal, send a signal to an actuator of a working machine to move the carriage at the desired rate of change of position and/or to oscillate the carriage at the desired frequency and/or amplitude of oscillation.

The controller of the third aspect may have one or more optional features of the control system of the second aspect.

In a third aspect the invention provides a method of operation of a working machine of the type having a ground engaging structure; a propulsion system for moving the working machine via the ground engaging structure; a body supported on the ground engaging structure; a working arm connected to the body and a carriage at one end of the working arm for receiving an attachment; and a control system according to the second or third aspect, and wherein the control system includes a control device; the method comprising: moving the control device of the working machine to move the carriage, the rate of change of position of the carriage corresponding to the position of the control device with respect to a neutral position; and inputting a desired amplitude and/or frequency of oscillations of the carriage and initiating oscillations of the carriage.

The method may comprise adjusting the desired amplitude and/or frequency during oscillation of the carriage.

The desired amplitude and/or frequency may be inputted using the control device used to move the carriage.

BRIEF DESCRIPTION OF THE DRAWINGS

Embodiments of the invention will now be described with reference to the accompanying drawings, in which.

DETAILED DESCRIPTION OF EMBODIMENT(S)

Figure 1:
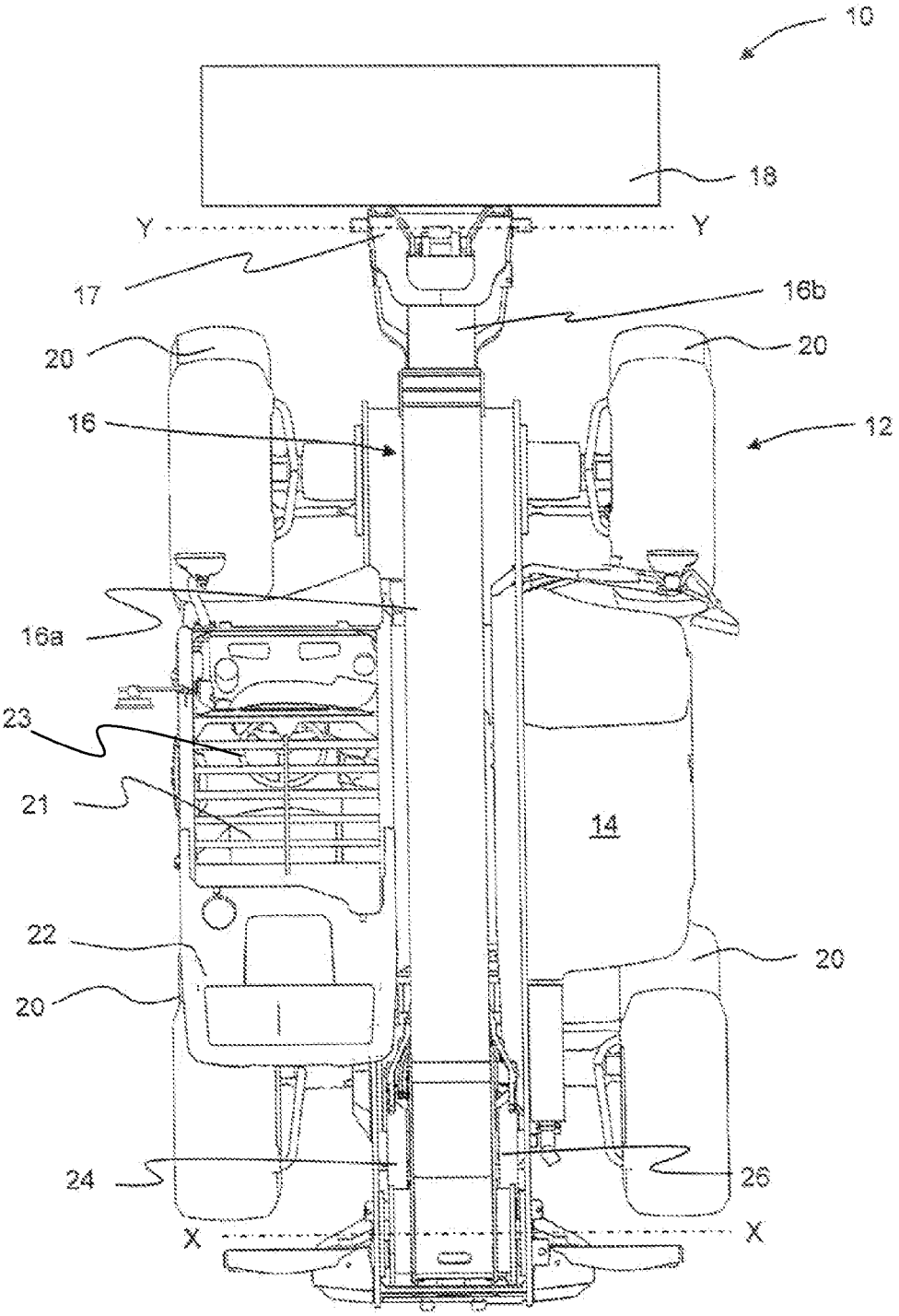
FIG. 1 shows a plan view of a working machine.

Referring to FIG. 1, a working machine is indicated generally at 10. The working machine 10 is a materials handling vehicle, more particularly a telescopic handler. The working machine 10 includes a ground engaging structure 12, a body 14 and a working arm 16 pivotally connected to the body 14 about a generally horizontal axis X-X. The working arm 16 is connected to a rear of the body 14 and extends to a front position of the body 14. An attachment, in this embodiment a shovel 18, is connected to an end of the working arm 16 positioned towards the front of the body 14. The shovel 18 is connected to the working arm 16 via a carriage 17.

In the present embodiment the ground engaging structure 12 includes four wheels 20, but in alternative embodiments the ground engaging structure may include an alternative number of wheels or tracks. The body 14 is supported on the ground engaging structure 12 and includes a cab 22 from which a user can drive and operate the working machine 10. An engine (not shown) is provided within the body 14 to provide motive power to the working machine, as well as to drive a pump (not shown) for a hydraulic system and an alternator (not shown) to power the electrical system.

In the present embodiment, the working arm 16 is a telescopic arm having inner and outer portions 16*a*, 16*b* that can slide relative to each other to increase the overall length of the arm.

To pivot the working arm 16 two hydraulic actuators 24, 26 are provided between the body 14 and the working arm 16. Extension of the hydraulic actuators pivots the working arm about a substantially horizontal axis X-X so as to move the shovel 18 away from the ground, and retraction of the hydraulic actuators pivots the working arm about axis X-X so as to move the shovel 18 towards the ground.

A further hydraulic actuator (not visible in FIG. 1) is provided within the working arm 16 to extend and retract the telescopic arm, such that the telescopic arm increases and decreases in length.

A yet further hydraulic actuator (not visible in FIG. 1) acts between the working arm 16 and the carriage 17 to tilt the shovel 18, such that extension or retraction of the hydraulic actuator rotates the shovel about a second substantially horizontal axis Y-Y.

The working machine 10 includes an electro-hydraulic ("servo") control system for controlling the hydraulic actuators of the working arm 16 so as to control the position of the working arm, the length of the working arm, and the angular position of the shovel 18. Such control systems are advantageous in that they reduce the amount of mechanical linkages/hydraulic hoses within a working machine of this type, and also allow greater freedom for the positioning of controls (e.g. to locate the input on a rotatable seat or steering wheel), since only electrical cabling or a wireless transmitter needs to connect the input to an electronic control unit (ECU).

A user operates the working machine 10 from the cab 22. The cab 22 includes a seat 21, a steering wheel 23, and various other physical controls for operating the working machine 10. One of such physical control is a joystick 52, shown in FIG. 2, which provides an input to the electro-hydraulic control system. In the present embodiment, the joystick is provided adjacent the seat 21 and is a digital joystick. In other embodiments, an analogue joystick may be used.

The joystick 52 is moveable in an X-direction and a Y-direction, e.g. forwards and backwards, side to side, and positions within a plane defined by the X and Y directions.

During standard operation of the working machine 10, referred to in the present application as operation in the positioning mode, movement of the joystick in the X-direction and/or Y-direction controls pivoting of the working arm 16 and tilting of the shovel 18. Movement of the joystick in the X-direction, i.e. in the present embodiment forwards and backwards controls pivoting of the working arm 16 about the axis X-X, and movement of the joystick in the Y-direction, i.e. in the present embodiment side to side controls tilting of the shovel 18 about axis Y-Y.

Figure 3:
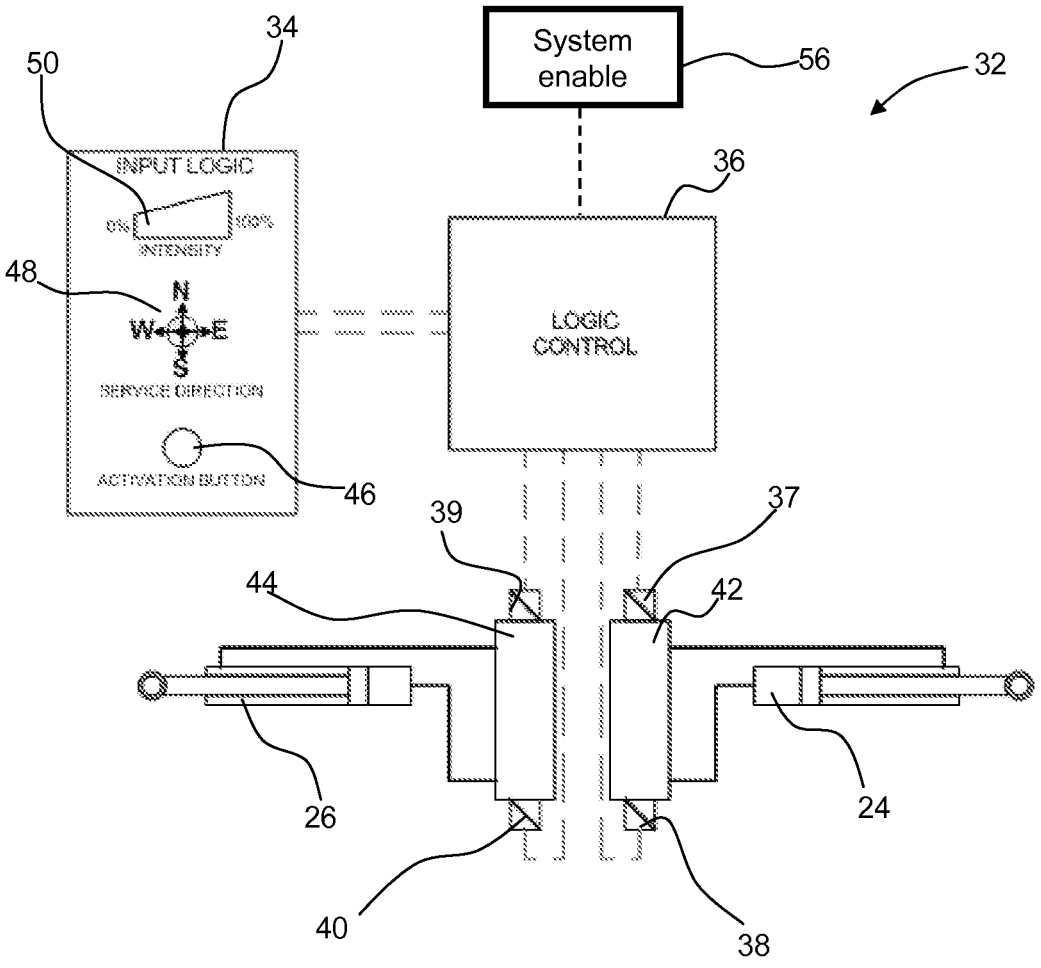
FIG. 3 shows a portion of a control system for operating the working machine of FIG. 1.

The joystick 52 is linked to the control system 32, part of which is shown in FIG. 3. The control system 32 includes an input device 34 in the form of a position encoder in the base of the joystick, an electronic control unit (ECU) 36 configured to receive input signals from the input device and to emit output signals to control valves 42, 44 via solenoids 37, 38, 39 and 40. The ECU may be any suitable type of microprocessor controller.

Valves 42, 44 control a supply of hydraulic fluid to the hydraulic actuators 24, 26 from the pump driven by the engine (not shown). The dashed lines indicate electrical connections between components of the control system and the solid lines indicate hydraulic connections between components of the control system.

The joystick 52 is configured to provide a mode of input to the input device 34 such that movement of the joystick, for example in a rearwards direction, sends a positioning signal 48 to the ECU. The positioning signal will contain information relating to the distance the joystick has been moved out of neutral, i.e. 0% to 100% from a neutral position. In the current embodiment, the signal is sent to the ECU via a CAN bus message (Controller Area Network bus message), in the present embodiment the control system uses the J1939 CAN bus.

The ECU 36 receives the CAN bus message of joystick position and determines an electrical signal to send to the solenoids 37, 38, 39, 40. In the present example of rearwards movement of the joystick the signal is sent to solenoids 38 and 40. The solenoids 38 and 40 then move the valves 42, 44 (which in this embodiment are spool valves) to a position that permits flow of fluid to the hydraulic actuators 24, 26 at a rate corresponding to the distance of the joystick 52 out of neutral. Flow of fluid to the hydraulic actuators 24, 26 moves the hydraulic actuators, and therefore the working arm (in this example) at a speed corresponding to the position of the joystick relative to the neutral position.

In the present embodiment, the position of the joystick 52 relative to the neutral position, i.e. 0% to 100% from the neutral position, is substantially proportional to the speed of movement the working arm. In the present embodiment, the ECU 36 is configured such that movement between 0% and 2% does not initiate movement of the relevant hydraulic actuator.

The example has been described for rearwards movement of the joystick 52 and lifting of the working arm 16 from the body. However, it will be appreciated that movement of the joystick in a forward direction causes lowering of the working arm towards the body 14 in a similar way. Movement of the joystick 52 in the Y-direction also causes tilting of the shovel 18 in a similar manner. The joystick 52 of the present embodiment is configured to permit movement in both the X-direction and the Y-direction at the same time, permitting simultaneous lifting or lowering of the working arm 16 and tilting of the shovel 18.

Referring back to FIG. 2, in this embodiment, the joystick 52 includes a scroll button 74. Movement of the scroll button in a forwards direction extends the working arm 16 and movement of the scroll button in a rearwards direction retracts the working arm 16. In alternative embodiments, an alternative type of input may be used, e.g. a mini joystick or slider-type switch. Movement of the scroll button in the forwards or rearwards direction causes extension or retraction of the working arm in a similar way as described for lifting and lowering the working arm 16.

The control system 32 of the present invention additionally permits the working machine to be operated in an oscillating mode that oscillates the working arm in a generally upward and downward direction about axis X-X, oscillates the carriage 17 about axis Y-Y, and/or oscillates between a degree of extension and retraction of the working arm 16. The oscillations are relatively rapid and have a relatively limited amplitude by comparison with typical positioning movements. As stated above, such oscillations are desirable in a number of different operating scenarios.

Figure 2:
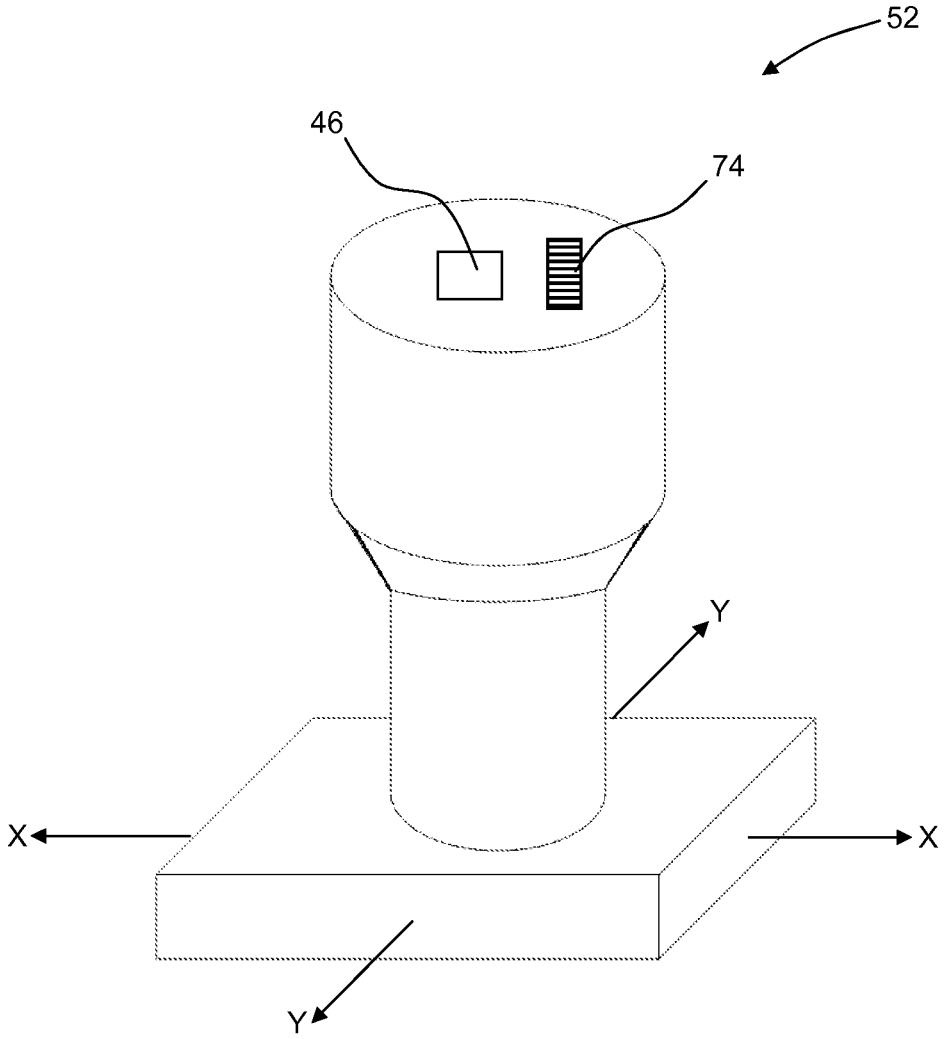
FIG. 2 schematically shows a joystick for providing an input to a control system for controlling the working machine of FIG. 1.

Referring to FIGS. 2 and 3, the joystick 52 further includes an activation button 46 that engages the oscillation mode by sending an appropriate signal to the ECU 36 via the CAN bus. In the oscillating mode, a desired intensity 50 of oscillations is indicated by the position of the joystick in the X-direction and/or the Y-direction; the further the joystick is out of the neutral position the greater the intensity of the oscillations.

In the oscillating mode, the ECU 36 includes logic that indicates a desired oscillation of the working arm 16. In the present embodiment, a suitable algorithm in conjunction with a lookup table is used to calculate the amplitude and/or frequency of an oscillation based on the percentage intensity 50 indicated by the position of the joystick. In this embodiment, the frequency is fixed, and the variation of intensity is a variation of amplitude only, but in other embodiments the amplitude may be fixed and the frequency varied, or both varied.

The algorithm and/or lookup table will vary depending on the type of machine and the intended use of the machine 10. The skilled person will be familiar with how to calculate the desired frequency and/or amplitude based on a percentage intensity of oscillations. In alternative embodiments, a separate input may be provided for amplitude and frequency so that a user can vary these parameters independently.

The ECU 36 sends a signal to the solenoids 37, 38, 39, 40 to open the valves 42, 44 to an amount that corresponds to the rate of required extension and retraction of the hydraulic actuators. The signal is a series of electrical pulses. For example, to oscillate hydraulic actuator 24, a series of pulses are sent to the solenoids 37 and 38. The pulses are out of phase such that the pulsed signal sent to the solenoid 37 is "on" when the pulsed signal sent to the solenoid 38 is "off", and vice-versa. The voltage, current or length of the pulse is dependent upon the percentage intensity indicated by the oscillation signal. In a preferred embodiment the signal is transmitted to the solenoids as a pulse width modulation (PWM) control.

The hydraulic actuators 24, 26 are retracted or extended using an hydraulic oil feed from the valve 42 or 44 via suitable pipework. The hydraulic actuators 24, 26 are of the type having a piston arranged within a cylinder. The oil feed is positioned to supply fluid into the cylinder on opposing sides of a piston within the cylinder, oil fed into one side of the piston causes the cylinder to retract and oil fed into the other side of the piston causes the cylinder to extend—i.e. the actuators are double acting. In alternative embodiments, arrangements using two opposed single-acting pistons, or a single-acting piston in one direction and gravity acting in an opposite direction are contemplated.

When the joystick 52 is in a neutral position and the oscillating mode activation button is depressed, although the ECU will receive an "oscillation mode active" message, no oscillation will in effect occur, because the neutral position indicates a zero oscillation intensity.

The control system is also supplied with a system enable switch 56. The system enable switch is configured to send a signal to the ECU to indicate whether the oscillation mode should be available for use (e.g. to prevent inadvertent use of this mode during inappropriate operational scenarios).

Figure 4:
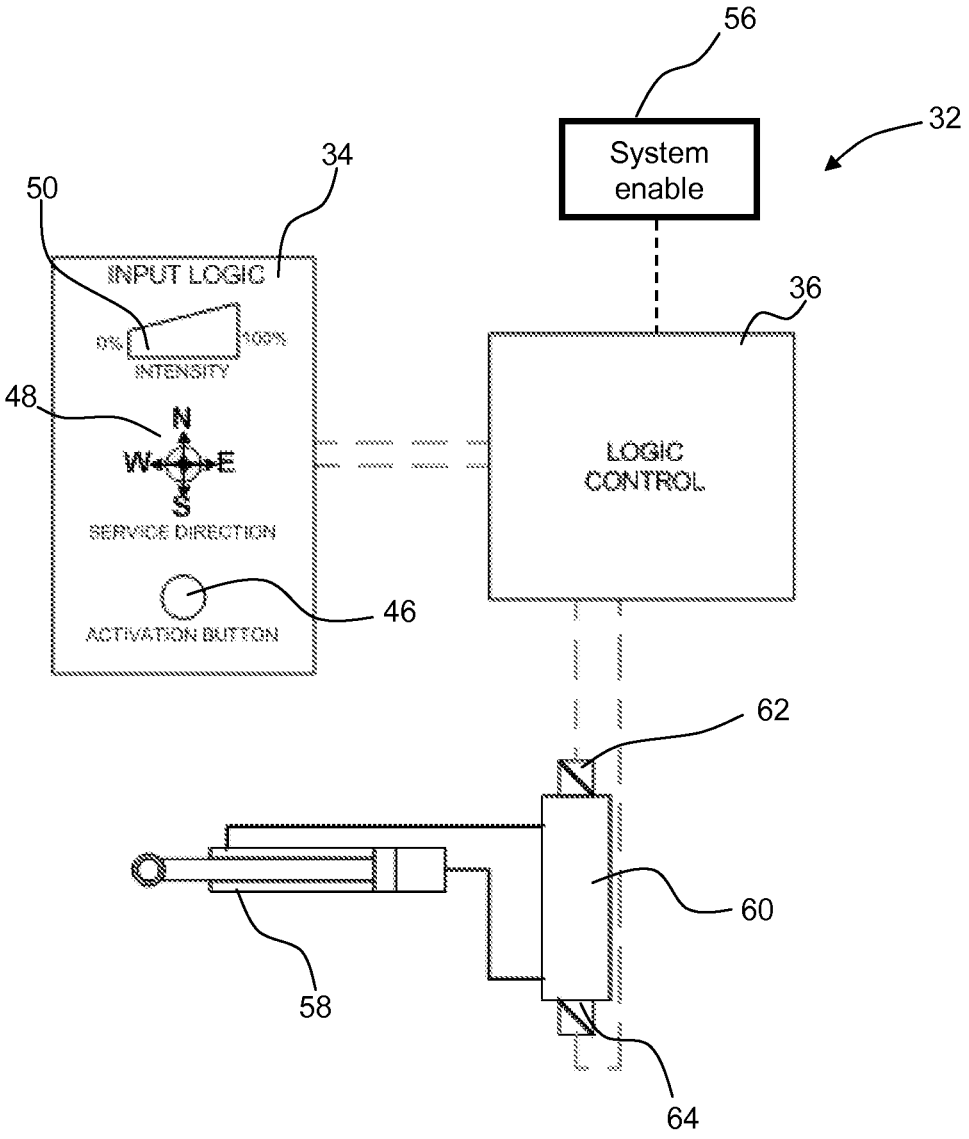
FIG. 4 shows a different portion of the control system of FIG. 2.

Referring to FIG. 4, the control system 32 is also used to control the hydraulic actuator 58 that controls the angle of tilt of the carriage 17.

Control of the tilt of the carriage 17 also has two modes of operation; positioning mode and oscillating mode. The two modes work in a similar manner to that described for positioning of the working arm 16. However, only one hydraulic actuator 58 is provided to tilt the carriage 17, so only one valve 60 and two solenoids 62, 64 are required to tilt and to oscillate the carriage 17.

Figure 5:
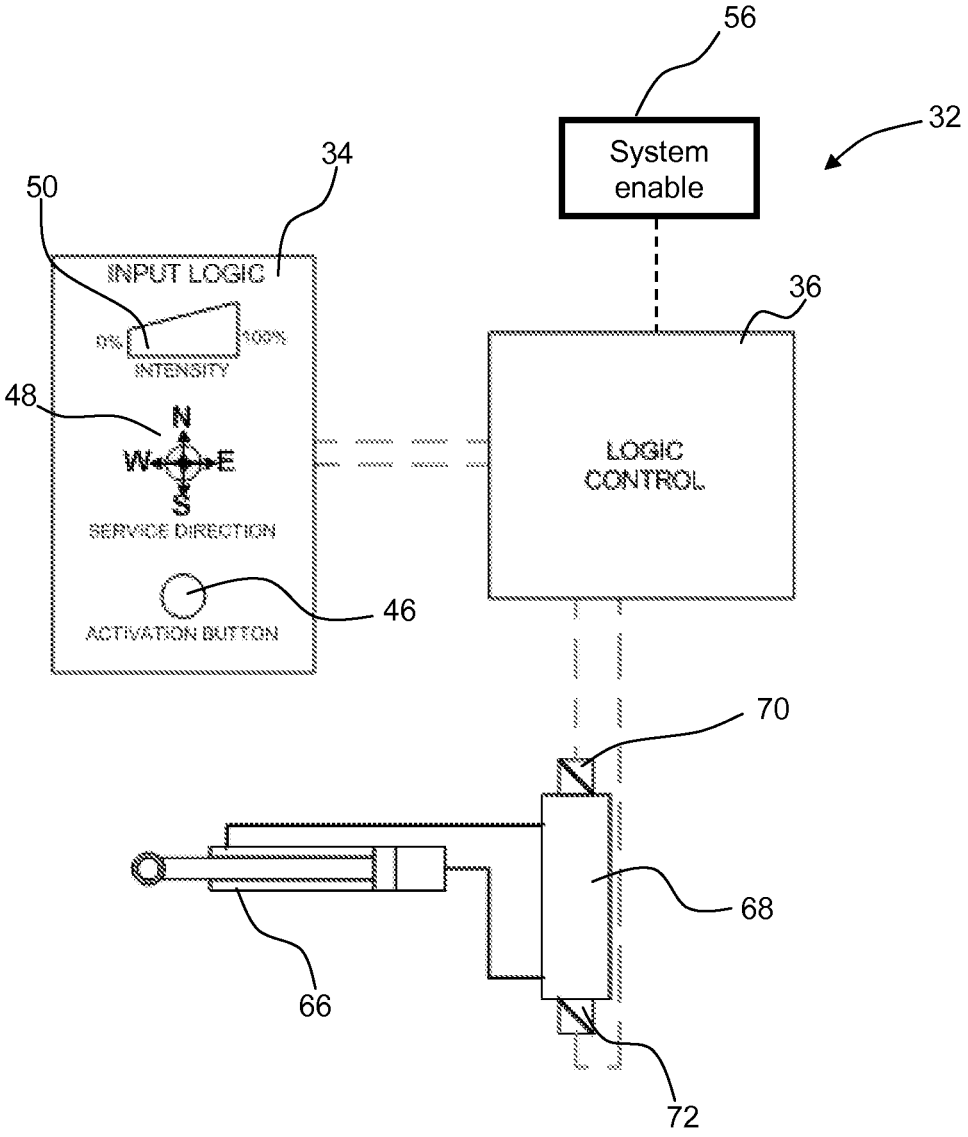
FIG. 5 shows a further different portion of the control system of FIG. 2.

Referring to FIG. 5, control of the length of the working arm 16 may also have two modes of operation; a positioning mode and an oscillating mode (although applications for the oscillating mode of the length of the working arm are considered more limited). The two modes work in a similar manner to that described for positioning of the working arm. However, only one hydraulic actuator 66 is provided to extend and retract the working arm 16, so only one valve 68 and two solenoids 70, 72 are provided.

Operation of the working machine 10 will now be described. Different uses of the working machine 10 are described to illustrate the operation, but these example operations are by way of example only and it is possible to use the working machine 10 for many other applications.

In a first example, an operator may be using the working machine 10 to move and manipulate a material that is prone to sticking to the shovel 18, such as wet soil.

Firstly, a user switches the system enable button 56 to indicate that the oscillating mode should be available.

To manipulate the material, a user moves the joystick 52 to change the position of the working arm 16 and to tilt the shovel 18, so as to e.g. pick up material and move it to another location.

Figure 6:
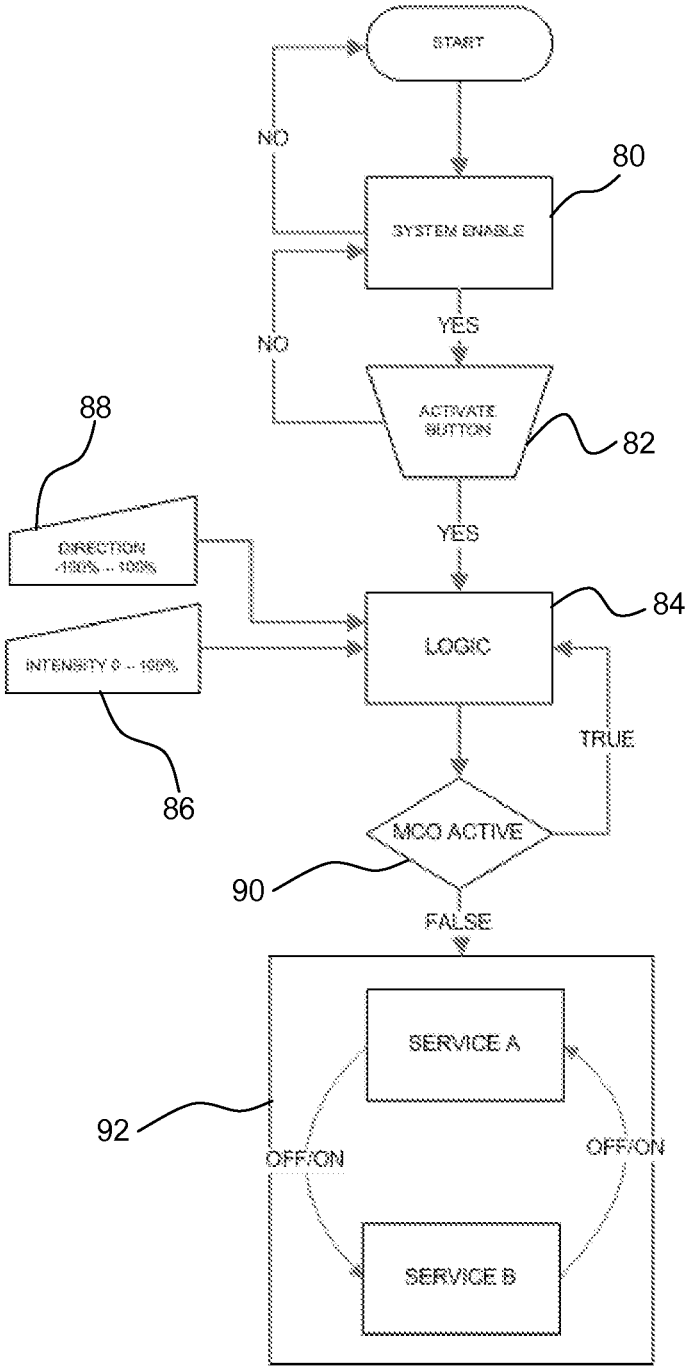
FIG. 6 shows control logic for operating the working machine of FIG. 1.

To empty material from the shovel 18, the joystick 52 is moved to the left along the Y-axis to tilt the shovel 18 forwards. If when emptying the shovel some of the material remains in the shovel because it has become stuck, a user will wish to oscillate the shovel to dislodge this material. The process followed by the control system to enable this to occur is set out in FIG. 6.

Firstly, (at step 80) the ECU 36 checks that the user has switched the system enable button 56 to enable oscillating mode. The ECU further monitors (at step 82) that the user has pressed the activation button 46. If yes, the ECU now follows the oscillation mode logic for joystick inputs at step 84. Accordingly, the ECU processes the signals corresponding to the intensity (86) and direction (88) of the joystick according to the oscillation logic instead of positioning logic. If the system enable button 56 or the activation button 46 have not been activated, then the ECU does not continue with processing a command to oscillate the shovel 18.

In the present example, the joystick 52 is displaced in the Y-axis which indicates that the shake should be in a tilt direction, i.e. the shovel 18 should be oscillated using hydraulic actuator 58.

The ECU processes the CAN bus messages that indicate the position of the joystick 52 to determine the voltage of the electric pulses that should be sent to the solenoids 62 and 64 to achieve motion of the hydraulic actuators that will result in the desired amplitude of oscillations. In the present embodiment, the frequency of oscillations is fixed, but in alternative embodiments the frequency may be variable.

The ECU then checks at step 90 the working machine master control ("MCO") to confirm no machine wide faults or unacceptable operating states exist (e.g. shovel payload too heavy for safe oscillation at the desired intensity). Only if no faults are indicated (i.e. MCO is not active) are the electric pulses are sent to the solenoids 62, 64.

To oscillate the shovel 18 (at 92), a first electrical signal is sent to the solenoid 62, which moves the valve 60 to a position that permits fluid to flow from the pump to one end of the piston within the cylinder at a rate to achieve the desired amplitude of oscillation. After a predetermined length of time, the first electrical signal ceases and the solenoid 62 closes. A second electrical signal is then sent to the solenoid 64, which moves the valve 60 to a position that permits fluid to flow from the pump to the other end of the piston within the cylinder. After a predetermined length of time, the electrical signal ceases and the solenoid 64 closes. The ECU continues to open and close the solenoids to oscillate the shovel 18 until the joystick 52 is moved to a neutral position and/or the activation button 46 is pressed.

During the oscillating mode a user can change the amplitude of the oscillations by moving the joystick 52 towards or away from a neutral position.

In the described example, the positioning mode and oscillating mode function separately. However, in alternative embodiments the positioning mode and oscillating mode may work simultaneously. This may be activated by a further switch (not shown) on the joystick 52, by making switch 46 have three positions (off, exclusively oscillation, and combined oscillation and positioning), or may be automatically programmed. An example where this mechanism would be useful is transporting grain from one position to another.

To transport the grain a user moves the joystick 52 in a left direction to tilt the shovel forward, and moves the joystick 52 in a forward direction to move the shovel 18 downwards. The scroll button 74 is then used to push the shovel 18 into a pile of grain, or alternatively the working machine 10 is driven forwards.

The joystick 52 is then moved to the right to pivot move the shovel backwards (crowd) optionally in combination with some lifting of the working arm.

To level the grain in the shovel 18 prior to transferring the grain e.g. to a trailer without spillage from the shovel, it is desirable to shake the shovel 18. Accordingly, a user presses the activation button 46 on the joystick 52, and as described the oscillation mode is activated. However, the shovel needs to be in an upright position to retain the grain in the shovel. As such, during the oscillation mode, the shovel simultaneously tilts more towards an upright position, whilst also oscillating. Tilting to the upright position is done slowly. Once in the upright position and the grain is leveled off, the oscillating mode is deactivated by ceasing to press the activation button 46 or returning the joystick 52 to a neutral position.

The working machine 10 may be used for a variety of other applications, by way of example only, these include distributing material such as aggregate from the shovel, breaking bales, breaking livestock feed cake, or breaking bundles. To break the bales, feed cake or bundles, it may be desirable to directly oscillate the working arm 16 instead of the carriage 17.

Advantageously the invention provides a method for oscillating an attachment of a working machine 10 that uses electro-hydraulic controls.

Further the working machine 10 provides a method of repeatably and adjustably oscillating an attachment (e.g. shovel 18). Providing all the input features on the joystick 52 means that a user can easily actuate the oscillating mode without the need to take their hand off the joystick. This provides both ergonomic advantages and the ability to simultaneously operate in the positioning mode and the oscillating mode.

Proportional control of the rate of change of position of the shovel relative to the body and also proportional control of the oscillations improves ease of use of the working machine because an operator an easily and repeatably set a desired intensity of oscillations.

Although the invention has been described above with reference to one or more preferred embodiments, it will be appreciated that various changes or modifications may be made without departing from the scope of the invention as defined in the appended claims.

For example, the control system 32 could be applied to an alternative types of working machines, for example backhoe loader (both backhoe and loader working arms), slew excavators, loading shovels, dump trucks (tipping mechanisms thereof being in effect the working arm), skid steer loaders, wheeled loaders etc. Additionally, an oscillation mode may be used on auxiliary hydraulic services that are provided on machines of these types to provide additional oscillating functionality to certain attachments that are connected to the carriage and incorporate hydraulic actuators (such as 6-in-1 shovels, grabs etc).

Further, an alternative method of controlling movement of the hydraulic actuator may be used. For example, a potentiometer input may be used to indicate intensity instead of the button and joystick combination.

Instead of the controls being provided on a single joystick, multiple joysticks may be used, or dials on e.g. a dashboard may be used. In alternative embodiments a jog/scroll wheel or mini joystick may be provided on the joystick and the scroll wheel or mini joystick may provide the oscillation input. The joystick may movable on one axis only, rather than two.

In the present embodiment, the oscillation amplitude is selected using an oscillation intensity parameter. But, in alternative embodiments the amplitude and frequency may be independently variable. Further alternatively, a time based logic, or a time and amplitude based logic instead of an amplitude based logic may be used to control the oscillations.

It will be appreciated that the direction of motion of the working arm and/or carriage, and/or the extension and retraction of the working arm has been described with reference to an exemplary direction of movement of the joystick and/or scroll button, but in alternative embodiments, a given direction of motion of the working arm and/or carriage, and/or the extension and retraction of the working arm may correspond to an alternative direction of movement of the joystick and/or scroll button. The exemplary embodiments have been described in relation to an electro-hydraulic actuation of working arms. However in other embodiments the invention may be applied to working machines having working arms moved by electric linear actuators.

The invention claimed is:

1. A working machine, comprising:

a ground engaging structure;

a propulsion system for moving the working machine via the ground engaging structure;

a body supported on the ground engaging structure;

a working arm connected to the body and having a carriage at one end for receiving an attachment; and a control system for selectively oscillating the carriage, wherein the control system comprises:

an actuator configured and arranged to selectively oscillate the carriage;

an electronic controller configured to control the actuator; and a user input device in communication with the controller;

wherein the user input device comprises an oscillation input configured to selectively transmit an oscillation signal to the electronic controller to indicate a desired amplitude and/or frequency of oscillation of the carriage, wherein the oscillation input is variable to alter the oscillation signal transmitted to the electronic controller, wherein the electronic controller is configured to upon receipt of the oscillation signal selectively activate the actuator to oscillate the carriage at the desired amplitude and/or frequency indicated by the oscillation signal, wherein the controller is configured to signal actuation of the actuator to move the carriage from a first position to a second position simultaneously whilst oscillating the carriage at the desired amplitude and/or frequency, and wherein the controller is configured to move the carriage in a desired direction at a slower rate when simultaneously moving and oscillating the carriage than when only moving the carriage.

2. The working machine according to claim 1, wherein the oscillation signal includes an intensity indicator, and the controller is configured to use an algorithm and/or lookup table for transforming the intensity indicator to the desired amplitude and/or frequency of oscillation.

3. The working machine according to claim 1, wherein simultaneous movement and oscillation of the carriage is selectively applied dependent upon a signal received from an indicator of the control system.

4. The working machine according to claim 1, wherein the desired change of position indicated by the position signal is proportional to the position of the control device with respect to the neutral position of the control device.

5. The working machine according to claim 1, wherein the controller is configured to detect when the control device is in the neutral position and only send a signal to actuate oscillations of the carriage when the input device is out of the neutral position.

* * * * *